US008861774B2

(12) United States Patent
Takeda et al.

(10) Patent No.: US 8,861,774 B2
(45) Date of Patent: Oct. 14, 2014

(54) SOUND REPRODUCTION DEVICE

(75) Inventors: Katsu Takeda, Osaka (JP); Fumiyasu Konno, Osaka (JP); Rihito Shoji, Osaka (JP); Susumu Fukushima, Osaka (JP)

(73) Assignee: Panasonic Patent Center, Washington, DC (US)

( * ) Notice: Subject to any disclaimer, the term of this patent is extended or adjusted under 35 U.S.C. 154(b) by 0 days.

(21) Appl. No.: 13/825,246

(22) PCT Filed: Aug. 23, 2011

(86) PCT No.: PCT/JP2011/004659

§ 371 (c)(1),
(2), (4) Date: Mar. 20, 2013

(87) PCT Pub. No.: WO2012/042733

PCT Pub. Date: Apr. 5, 2012

(65) Prior Publication Data

US 2013/0182883 A1 Jul. 18, 2013

(30) Foreign Application Priority Data

Sep. 27, 2010 (JP) ..... 2010-214889

(51) Int. Cl.

| | |
|---|---|
| ***H04R 25/00*** | (2006.01) |
| ***H04R 5/02*** | (2006.01) |
| ***H04R 1/32*** | (2006.01) |
| ***H04R 1/34*** | (2006.01) |
| *H04R 1/02* | (2006.01) |
| *H04R 1/06* | (2006.01) |

(52) U.S. Cl.

CPC ..... *H04R 1/345* (2013.01); *H04R 2201/025* (2013.01); *H04R 2499/13* (2013.01); *H04R 5/02* (2013.01); *H04R 1/323* (2013.01); *H04R 1/026* (2013.01); *H04R 2217/03* (2013.01); *H04R 1/06* (2013.01)

USPC ..... 381/387; 381/303

(58) Field of Classification Search

USPC ..... 381/71.7, 107, 386–390, 86–87, 381/303–306; 181/199

See application file for complete search history.

(56) References Cited

U.S. PATENT DOCUMENTS

| | | | | |
|---|---|---|---|---|
| 8,379,902 | B2 * | 2/2013 | Koseki | 381/387 |
| 8,666,106 | B2 * | 3/2014 | Konno et al. | 381/387 |

(Continued)

FOREIGN PATENT DOCUMENTS

| | | | |
|---|---|---|---|
| JP | 52-033855 | Y1 | 8/1977 |
| JP | 06-178379 | A | 6/1994 |

(Continued)

OTHER PUBLICATIONS

International Search Report mailed Oct. 11, 2011 issued in corresponding International Application No. PCT/JP2011/004659.

*Primary Examiner* — Davetta W Goins
*Assistant Examiner* — Phylesha Dabney
(74) *Attorney, Agent, or Firm* — McDermott Will & Emery LLP

(57) ABSTRACT

A sound reproduction device includes a superdirective speaker having a first surface, and an attachment part having a second surface opposed to the first surface. The first surface has a convex face, and the second surface has a concave face which can come into contact with the convex face. A curvature of the convex face is set larger than that of the concave face. A direction of emitting a sound wave of the superdirective speaker can be adjusted by making the convex face move along the concave face.

10 Claims, 14 Drawing Sheets

(56) References Cited

U.S. PATENT DOCUMENTS

| | | | | |
|---|---|---|---|---|
| 2004/0247140 | A1* | 12/2004 | Norris et al. | 381/77 |
| 2013/0076504 | A1* | 3/2013 | Nakayama | 340/466 |
| 2013/0077803 | A1* | 3/2013 | Konno et al. | 381/107 |
| 2013/0163795 | A1* | 6/2013 | Takeda et al. | 381/303 |
| 2013/0266151 | A1* | 10/2013 | Kishinami et al. | 381/71.7 |

FOREIGN PATENT DOCUMENTS

| | | | |
|---|---|---|---|
| JP | 2743603 | B2 | 4/1998 |
| JP | 2002-218580 | A | 8/2002 |
| JP | 2005-027054 | A | 1/2005 |
| JP | 2006-333122 | A | 12/2006 |

* cited by examiner

SOUND REPRODUCTION DEVICE

RELATED APPLICATIONS

This application is the U.S. National Phase under 35 U.S.C. §371 of International Application No. PCT/JP2011/004659, filed on Aug. 23, 2011, which in turn claims the benefit of Japanese Application No. 2010-214889, filed on Sep. 27, 2010, the disclosures of which Applications are incorporated by reference herein.

TECHNICAL FIELD

The present invention relates to a sound reproduction device using a superdirective speaker.

BACKGROUND ART

Conventionally there is a sound reproduction device for transmitting sound information only to an object person by using a speaker which gives directionality to sound information including information of sound such as voice. For example, many information transmitting devices each provided for a vehicle to transmit information such as alarm sound only to a driver are proposed (refer to, for example, patent literature 1).

FIG. 13 is a layout of speakers of a conventional information transmitting device. Speakers 107 are installed at a base of door mirrors 103 below front pillars 101 on right and left sides of a vehicle body. Speakers 107 generate an ultrasonic wave toward the head position of driver 105.

The vehicle measures distance to an obstacle and transmits alarm sound to driver 105 in accordance with the distance. Right and left speakers 107 output ultrasonic waves of different frequencies. Right and left speakers 107 are disposed so that directivity axes indicative of travel directions of the ultrasonic waves emitted toward driver 105 cross in the head position of driver 105. The frequencies of the ultrasonic waves output from right and left speakers 107 are set so that frequency of a beat which is caused by mutual interference of the two frequencies belongs to an audible range. Therefore, the ultrasonic waves of the two difference frequencies become audible sound around the head of driver 105, and information can be transmitted as alarm sound to driver 105. On the other hand, around an occupant in another seat, the directivity axes of right and left speakers 107 do not cross and no beat is generated by the beat caused by the two ultrasonic waves, so that the alarm sound is not perceived. Since the directivity can be given to the alarm sound in such a manner, the alarm sound can be transmitted only to driver 105.

In the conventional information transmitting device as illustrated in FIG. 13, to transmit information as the alarm sound only to driver 105 among vehicle occupants, speakers 107 which emit an ultrasonic wave having high directivity are used. Consequently, even in the case of giving alarm to driver 105, the alarm sound is perceived only by driver 105, and the other occupants do not hear the alarm sound and, therefore, are not bothered.

CITATION LIST

Patent Literature

PTL 1: Japanese Patent Publication No. 2,743,603

SUMMARY OF THE INVENTION

The present invention relates to a sound reproduction device having a mechanism of adjusting an angle of radiating a sound wave of a superdirective speaker as a speaker having a characteristic that a sound wave emitted has high directivity, and the angle can be easily adjusted by a person who listens to information or the like.

A sound reproduction device of the present invention includes: a superdirective speaker having a sound wave emitting face for emitting an ultrasonic wave and a first surface; and an attachment part having a second surface opposed to the first surface. The first surface has a convex face. The second surface has a concave face which can come into contact with the convex face. A curvature of the convex face is set larger than that of the concave face. A direction of emitting a sound wave of the superdirective speaker is adjusted by changing tilt of the sound wave emitting face by moving the convex face along the concave face.

According to the sound reproduction device of the present invention, turn in the circumferential direction and tilt in the thickness direction of the superdirective speaker can be simultaneously or independently performed, so that the direction of emitting a sound wave of the superdirective speaker can be easily adjusted by a listener.

DESCRIPTION OF EMBODIMENTS

Hereinafter, embodiments of the present invention will be described with reference to the drawings.

First Exemplary Embodiment

Figure 1:
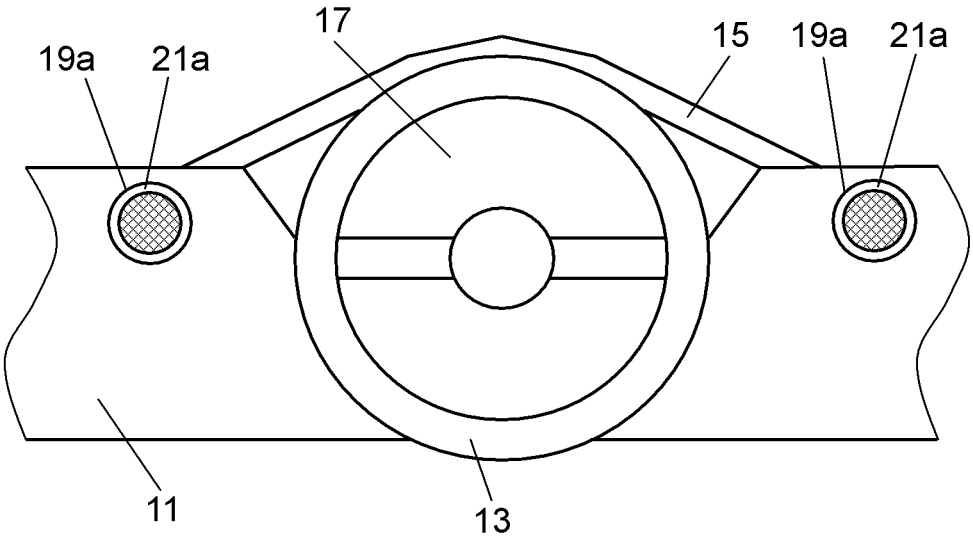
FIG. 1 is a layout illustrating an example of positions of disposing superdirective speakers of a sound reproduction device in a first embodiment.

FIG. 1 is a layout illustrating an example of positions of disposing superdirective speakers of a sound reproduction device in a first embodiment. In FIG. 1, steering wheel 13 is attached to dashboard 11 of a vehicle. Meter hood 15 is formed in a part of dashboard 11. Meter 17 is assembled below meter hood 15. In attachment parts 19*a* provided on the right and left sides of steering wheel 13, of dashboard 11, superdirective speakers 21*a* are installed.

Superdirective speaker 21*a* has a characteristic that sound pressure of audible sound has a peak in predetermined distance in the sound axis direction in which sound waves propagate from the position of superdirective speaker 21*a*, and uses ultrasonic waves as carrier waves.

A drive controller electrically controls driving of superdirective speakers 21*a* and, on the basis of a control signal from the vehicle, makes sound waves emitted from superdirective speakers 21*a*.

Generally, when the amplitude of a sound wave is increased and the sound wave is emitted to a medium such as air or water, as the sound wave propagates in the medium, the elastic characteristic of the medium itself (volume change to pressure change) which is linear becomes nonlinear. When the elastic characteristic of the medium becomes nonlinear, the waveform of the sound wave is deformed, and the sound wave comes to have a frequency component other than the original frequency component emitted.

Superdirective speaker 21*a* uses the above-described characteristic of the medium. When a sound wave obtained by superimposing an audible sound component on an ultrasonic wave is emitted into air, the emitted sound wave is subject to the influence of nonlinearity of the elastic characteristic of the air. As the emitted sound wave propagates in the air, the waveform of the ultrasonic wave as the carrier wave is deformed, and attenuation starts from the component of the ultrasonic wave having higher frequency. When the component of the ultrasonic wave having high frequency attenuates, the component of the audible sound superimposed on the ultrasonic wave is reproduced at a frequency lower than that of the ultrasonic wave.

The sound pressure of the audible sound emitted from a conventional speaker is the highest in the position of a sound wave emitting surface of the speaker in the sound axis direction in which the sound wave travels and decreases with distance from the emitting surface of the speaker. On the other hand, the sound pressure of the audible sound emitted from superdirective speaker 21*a* is very low around the emitting surface of superdirective speaker 21*a* but increases as the sound wave propagates in the air. Consequently, the sound pressure of the audible sound from superdirective speaker 21*a* has a characteristic that the sound pressure depends on distance in the sound axis direction in which the sound pressure has a peak in predetermined distance from the emitting surface.

The predetermined distance at which the sound pressure of the audible sound emitted from superdirective speaker 21*a* becomes the peak is determined by a structural characteristic of superdirective speaker 21*a*, an electric characteristic such as carrier frequency based on the structural characteristic, and the like.

Generally, the higher the frequency of the sound wave is, the more the sound wave propagates without being expanded from the sound axis. Consequently, the radiation angle of the sound wave having high frequency becomes smaller and the directivity becomes higher. Therefore, the directivity of sound wave emitted from a superdirective speaker using an ultrasonic wave having frequency higher than that of audible sound as a carrier wave is high and, by the influence of the nonlinearity of the elastic characteristic of air, the directivity of audible sound generated in the process of propagation of the ultrasonic wave also becomes higher.

Therefore, the sound pressure of the audible sound from superdirective speaker 21*a* has a characteristic which depends on the distance in the direction perpendicular to the sound axis also in a direction perpendicular to the sound axis in which the ultrasonic wave propagates. The sound pressure is high around the sound axis and becomes lower with distance from the sound axis.

Figure 2:
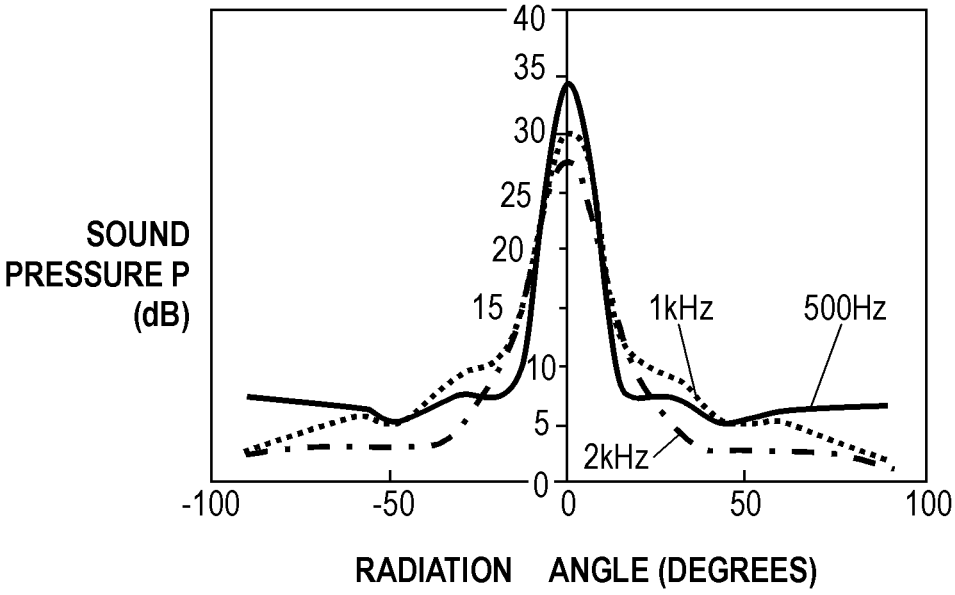
FIG. 2 is a directivity characteristic diagram of audible sound of the superdirective speaker of the sound reproduction device in the first embodiment.

FIG. 2 is a directivity characteristic diagram of audible sound of the superdirective speaker of the sound reproduction device in the first embodiment. In FIG. 2, the vertical axis indicates the sound pressure of the audible sound from superdirective speaker 21*a*, and the horizontal axis indicates the radiation angle of the audible sound from superdirective speaker 21*a*. As illustrated in FIG. 2, at any frequencies of the audible sound of 500 Hz (solid line), 1 kHz (broken line), and 2 kHz (alternate long and short dash line), the sound pressure of each of the frequencies decreases by about 20 dB around ±10 degrees of the radiation angle from the sound axis.

As described above, superdirective speaker 21*a* has excellent directivity. For example, it is assumed that the distance from superdirective speaker 21*a* to the listener who listens to the audible sound of superdirective speaker 21*a* is 1 m. In this case, a deviation of 10 degrees of the sound axis of the ultrasonic wave emitted from superdirective speaker 21*a* corresponds to a deviation of about 0.17 m in the position of the listener.

Therefore, to transmit acoustic information only to a specific listener, the emitting direction of the sound wave of superdirective speaker 21*a* positioned in a far place has to be adjusted with precision in consideration of the seat position, the build, and the like of the listener.

Desirably, the adjustment is preliminarily set by a vehicle manufacturer and, in addition, the listener of the acoustic information of superdirective speaker 21*a* adjusts the angle in accordance with the build, the seat position, and the like of the listener himself/herself. The listener himself/herself adjusts the angle of the sound axis of superdirective speaker 21*a*, so that the range in which the ultrasonic wave emitted from superdirective speaker 21*a* becomes audible sound can be adjusted to the seat position of the listener.

Consequently, the sound reproduction device in the first embodiment has a mechanism capable of adjusting the emitting direction of the sound wave from superdirective speaker 21*a* with high precision. Hereinafter, the mechanism and operation will be described.

Figure 3:
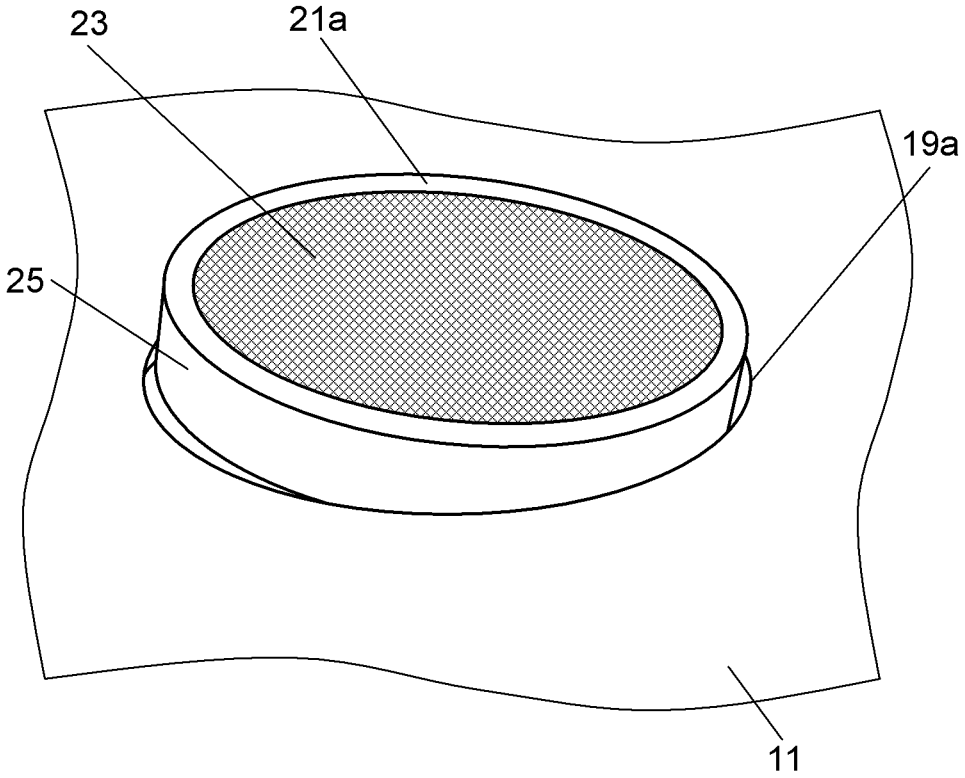
FIG. 3 is a perspective view when the angle of the sound reproduction device in the first embodiment is adjusted.
Figure 4A:
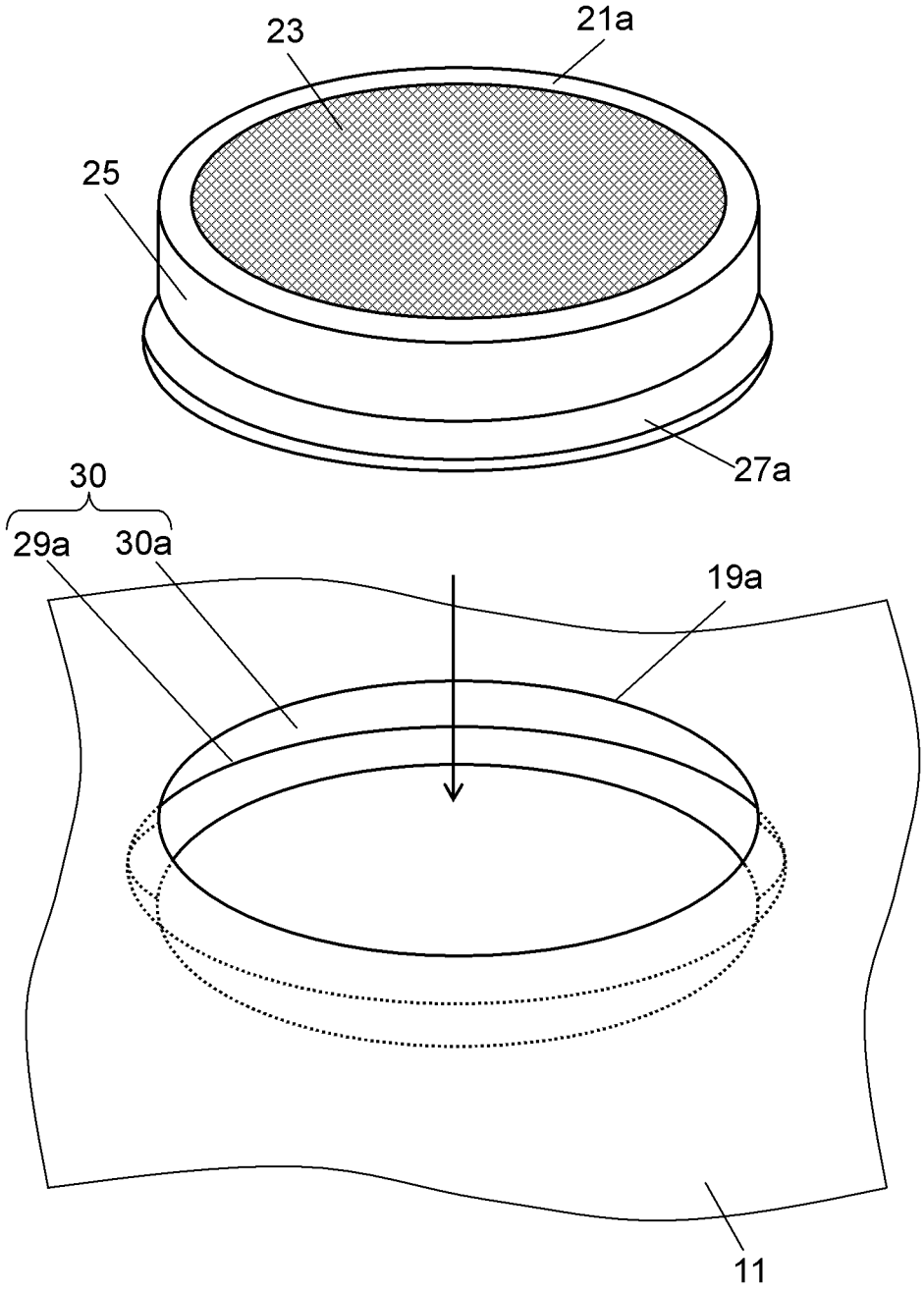
FIG. 4A is a partial exploded perspective view of the sound reproduction device in the first embodiment.
Figure 4B:
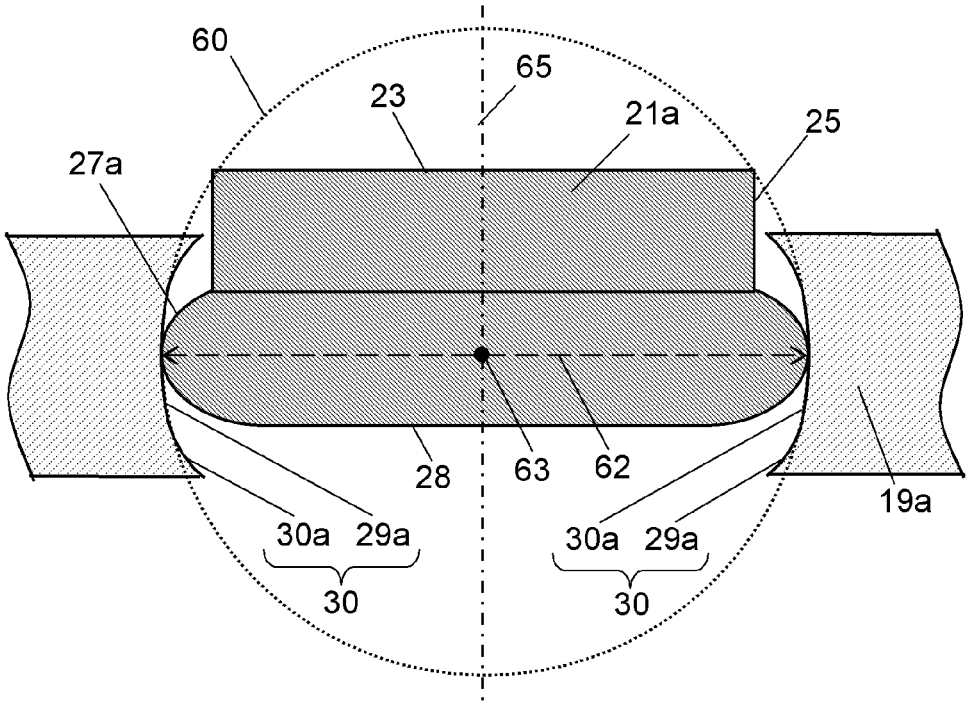
FIG. 4B is a sectional schematic view of the sound reproduction device in the first embodiment.
Figure 4C:
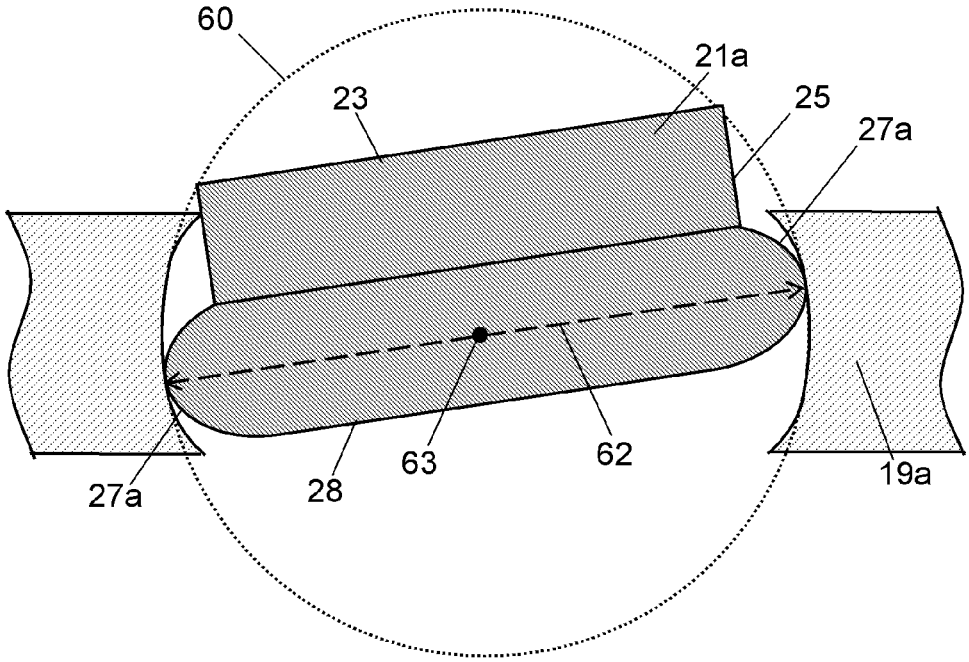
FIG. 4C is a sectional schematic view when the angle of the sound reproduction device in the first embodiment is adjusted.

FIG. 3 is a perspective view when the angle of the sound reproduction device in the first embodiment is adjusted. FIG. 4A is a partial exploded perspective view of the sound reproduction device in the first embodiment. FIG. 4B is a sectional schematic view of the sound reproduction device in the first embodiment. FIG. 4C is a sectional schematic view when the angle of the sound reproduction device in the first embodiment is adjusted.

The sound reproduction device in the first embodiment includes superdirective speaker 21*a* having sound wave emitting face 23 for emitting ultrasonic waves and side surface 25, and attachment part 19*a* having wall face 30 opposed to side surface 25. Side surface 25 has convex face 27*a*. Attachment part 19*a* has wall face 30. Wall face 30 has concave face 29*a* which can be in contact with convex face 27*a*.

In FIG. 3, the appearance of superdirective speaker 21*a* has an almost columnar shape. More concretely, superdirective speaker 21*a* substantially has a columnar shape having top surface 23, under surface (28), and side surface 25 connected to top surface 23 and under surface (28). In the first embodiment, the top surface is sound wave emitting face 23. Center axis 65 in FIG. 4B corresponds to the center axis of the columnar shape. Hereinafter, center axis 65 direction will be called a thickness direction of superdirective speaker 21*a*, and the distance from sound wave emitting face 23 in center axis 65 direction of the columnar shape to under surface 28 will be called thickness of superdirective speaker 21*a*.

Superdirective speaker 21*a* is disposed so that a part of the top part of side surface 25 is projected from dashboard 11. Superdirective speaker 21*a* is disposed in attachment part 19*a* provided for dashboard 11 in a lower part in its thickness direction.

In FIG. 4A, superdirective speaker 21*a* has convex face 27*a* in a part of side surface 25, in this case, in the entire circumference on the lower side (dashboard 11 side) of side surface 25. Attachment part 19*a* provided for dashboard 11 has, in its wall face 30, concave face 29*a* which can come into contact with convex face 27*a*. Wall face 30 is constructed by concave face 29*a* which can come into contact with convex face 27*a* and a face 30*a* other than concave face 29*a*. As illustrated in FIG. 4B, when concave face 29*a* comes into contact with convex face 27*a*, attachment part 19*a* supports superdirective speaker 21*a*.

The relation between convex face 27*a* and concave face 29*a* in the first embodiment will be described.

As illustrated in FIG. 4A, the entire periphery of wall face 30 is formed by a curved face. Spherical face 60 of a virtual sphere illustrated in FIG. 4B is a spherical face of a sphere having a diameter slightly larger than largest outside diameter 62 of superdirective speaker 21*a*. In the first embodiment, concave face 29*a* is a face which is opposed to and can come into contact with convex face 27*a* and is a face on wall face 30 having the same curvature as that of spherical face 60. That is, the face having the same curvature as that of spherical face 60 of the virtual sphere, on wall face 30 in FIG. 4B is concave face 29*a*. Concave face 29*a* has a constant curvature. Face 30*a* other than concave face 29*a* of wall face 30 has a curvature larger than that of concave face 29*a*.

The curvature of convex face 27*a* and that of concave face 29*a* are curvatures in a section including center axis 65. That is, they are curvatures in the thickness direction of superdirective speaker 21*a*.

Convex face 27*a* is a face having a curvature larger than that of concave face 29*a* on side surface 25 of superdirective speaker 21*a*. Side surface 25 has convex face 27*a* in the entire periphery of side surface 25. Superdirective speaker 21*a* has largest outside diameter 62 in a part of convex face 27*a*. When convex face 27*a* having largest outside diameter 62 of superdirective speaker 21*a* and concave face 29*a* come into contact with each other, superdirective speaker 21*a* is supported by attachment part 19*a*.

As illustrated in FIG. 4C, convex face 27*a* can move along concave face 29*a*. Also when convex face 27*a* moves along concave face 29*a*, convex face 27*a* at largest outside diameter 62 of superdirective speaker 21*a* is in contact with a part of concave face 29*a*. In other words, concave face 29*a* of wall face 30 is positioned on spherical face 60 of the virtual sphere having the diameter slightly larger than largest outside diameter 62 of superdirective speaker 21*a*.

The thickness of attachment part 19*a* in which concave face 29*a* is formed is larger than that of superdirective speaker 21*a* in which convex face 27*a* is formed.

As described above, convex face 27*a* and concave face 29*a* have the relation that at least the curvature in the thickness direction of convex face 27*a* is larger than that in the thickness direction of concave face 29*a*. Further, concave face 29*a* is a face which is opposed to and can come into contact with convex face 27*a* and is a face on wall face 30, having the same curvature as that of spherical face 60 of the virtual sphere.

Face 30*a* on wall face 30 does not have to have a constant curvature. For example, the curvature of face 30*a* may be larger or smaller than the curvature of concave face 29*a* (the curvature of the spherical face 60).

By changing a structural element such as the curvature or face roughness, of convex face 27*a* and concave face 29*a* which can come into contact with each other and an element of a chemical treatment on the contact faces or the like, turnability in the circumferential direction or tiltability in the thickness direction of superdirective speaker 21*a* can be changed.

With the configuration and operation as described above, for example, the listener can turn or tilt superdirective speaker 21*a* by holding side surface 25 of superdirective speaker 21*a* by his/her hand. In such a manner, the listener can set sound wave emitting face 23 of superdirective speaker 21*a* in an arbitrary direction as illustrated in FIG. 3.

Therefore, the sound reproduction device in which sound wave emitting face 23 of superdirective speaker 21*a* set in attachment part 19*a* in dashboard 11 can be arbitrarily adjusted by a listener can be realized.

In the configuration of FIG. 1, two superdirective speakers 21*a* as components of the sound reproduction device are installed on the right and left sides of steering wheel 13. One of superdirective speakers 21*a* may be disposed or three or more superdirective speakers 21*a* may be set. The positions of superdirective speakers 21*a* are not limited to the right and left sides of steering wheel 13. It is sufficient to set superdirective speakers 21*a* in positions where the sound wave from superdirective speakers 21*a* can be transmitted to a specific listener such as a driver or an occupant or in positions where the sound wave can be transmitted to a specific listener such as a driver or an occupant by using reflection from the wall face or the like in the vehicle.

The shape of convex face 27*a* of superdirective speaker 21*a* is not limited to a curved face having a specific curvature but may be, for example, a shape having a sharp part whose sectional shape is a triangle or the like. The curvature of convex face 27*a* may not be constant. By a combination of curved faces of different curvatures, convex face 27*a* may be constructed.

Convex face 27*a* is not limited to the configuration that it is formed in the entire periphery of side surface 25 but a plurality of convex faces 27*a* may be provided partially. In the case of providing a plurality of convex faces 27*a*, to hold superdirective speaker 21*a* in attachment part 19*a*, a configuration that the plurality of convex faces 27*a* are provided at almost equal intervals on the outer periphery of side surface 25 is preferable. The plurality of convex faces 27*a* may be supported by one concave face 29*a* or a plurality of concave faces 29*a*. Also in the case of supporting the plurality of convex faces 27*a* by the plurality of concave faces 29*a*, when all of the plurality of concave faces 29*a* is in spherical face 60 of the virtual sphere, the plurality of convex faces 27*a* can move on the corresponding plural concave faces 29*a*.

The shape of concave face 29*a* in attachment part 19*a* is also not limited to the above-described shape but may be a shape which corresponds to the shape of convex face 27*a* and which can hold superdirective speaker 21*a* in attachment part 19*a* and turn or tilt superdirective speaker 21*a*.

In superdirective speaker 21*a* of the first embodiment, sound wave emitting face 23 may be entirely or partly a mirror face. When the listener himself/herself adjusts the direction of superdirective speaker 21*a*, the listener can quite easily judge that sound wave emitting face 23 is directed toward the listener since the face, the eyes, or the like of the listener is/are reflected in a mirror surface of sound wave emitting face 23. Therefore, the direction of superdirective speaker 21*a* can be more easily adjusted.

To make the surface of sound wave emitting face 23 a mirror face, for example, sound wave emitting face 23 may be made of resin or metal subjected to mirror-like finishing. A mirror, a resin piece, a metal piece, or the like subjected to mirror-like finishing, or the like may be adhered to a part of sound wave emitting face 23. A mirror face part may be formed by performing plating process or the like on at least a part of the surface of sound wave emitting face 23.

Second Exemplary Embodiment

Figure 5:
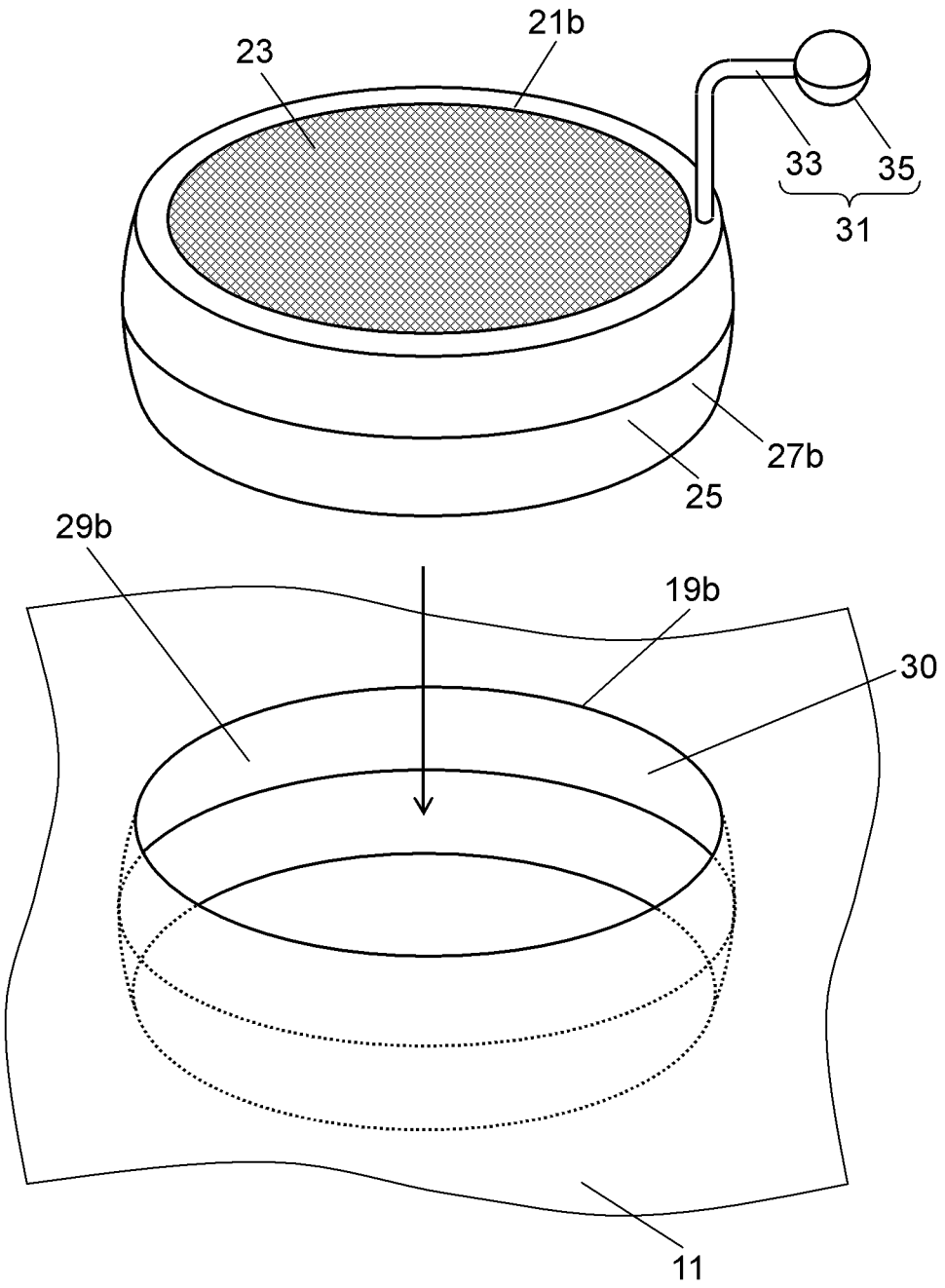
FIG. 5 is a partial exploded perspective view of a sound reproduction device in a second embodiment.
Figure 6A:
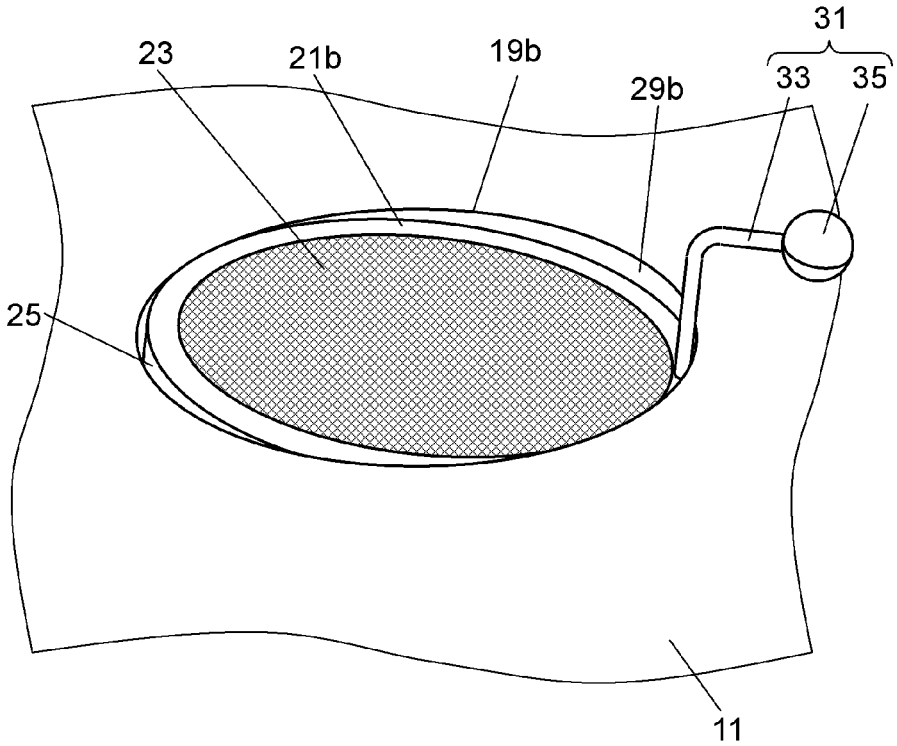
FIG. 6A is a perspective view when the angle of the sound reproduction device in the second embodiment is adjusted.
Figure 6B:
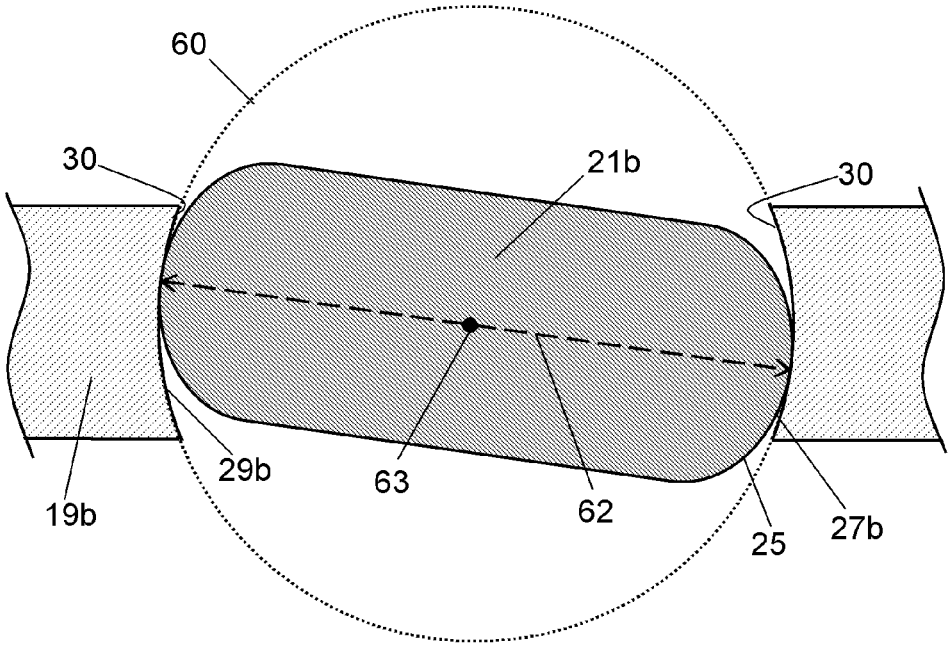
FIG. 6B is a sectional schematic view when the angle of the sound reproduction device in the second embodiment is adjusted.

FIG. 5 is a partial exploded perspective view of a sound reproduction device in a second embodiment. FIG. 6A is a perspective view when the angle of the sound reproduction device in the second embodiment is adjusted. FIG. 6B is a sectional schematic view when the angle of the sound reproduction device in the second embodiment is changed.

In FIGS. 5, 6A, and 6B, the same reference numerals are designated to the same components as those of the sound reproduction device of FIG. 3 and FIGS. 4A to 4C and their description will not be repeated. The sound reproduction device in the second embodiment is different from the sound reproduction device in the first embodiment with respect to the points that it has an angle adjusting unit 31 which is set in superdirective speaker 21*b*, has convex face 27*b* in place of convex face 27*a*, and has concave face 29*b* in place of concave face 29*a* and face 30*a*.

In FIG. 5, angle adjusting unit 31 has L-shaped arm 33 which is installed in a peripheral part on sound wave emitting face 23 of superdirective speaker 21*b* and spherical grip 35 attached to the end on the side opposite to the peripheral part on superdirective speaker 21*b* of arm 33.

In the second embodiment, in side surface 25 of superdirective speaker 21*b*, convex face 27*b* is formed entirely in side surface 25. Hereinafter, entire side surface 25 will be called convex face 27*b*.

On the other hand, in entire wall face 30 of attachment part 19*b* in dashboard 11, concave face 29*b* is formed. The curvature of convex face 27*b* of side surface 25 of superdirective speaker 21*b* is slightly larger than that of concave face 29*b* of wall face 30 of attachment part 19*b*. Concave face 29*b* has characteristics similar to those of concave face 29*a* illustrated in FIG. 4B of the first embodiment. Specifically, also in the second embodiment, it is assumed that concave face 29*b* is a face which can be in contact with convex face 27*b* and is a face on wall face 30 and having the same curvature as that of spherical face 60 of a virtual sphere illustrated in FIG. 6B. Although wall face 30 is constructed by concave face 29*a* and face 30*a* as faces of different curvatures in the first embodiment, the entire wall face 30 is constructed by concave face 29*b* having constant curvature in the second embodiment. Therefore, convex face 27*b* can move along entire wall face 30.

With such a configuration, a listener can turn superdirective speaker 21*b* in the circumferential direction or tilts it in the thickness direction in a state where superdirective speaker 21*b* is held in attachment part 19*b*.

By changing a structural element such as the curvature or face roughness, of convex face 27*b* and concave face 29*b* which can come into contact with each other and an element of a chemical treatment on the contact faces or the like, turnability in the circumferential direction or tiltability in the thickness direction of superdirective speaker 21*b* can be changed.

By installing angle adjusting unit 31, as illustrated in FIG. 6A, superdirective speaker 21*b* can be disposed without making anything projected from dashboard 11 except for angle adjusting unit 31 of superdirective speaker 21*b*.

With the configuration and operation as described above, for example, the listener can turn or tilt superdirective speaker 21*b* with angle adjusting unit 31 of superdirective speaker 21*b*. Therefore, the listener can set sound wave emitting face 23 of superdirective speaker 21*b* in an arbitrary direction.

Thus, the sound reproduction device such that a listener can arbitrarily set the direction of sound wave emitting face 23 without making sound wave emitting face 23 of superdirective speaker 21*b* projected from dashboard 11 can be realized.

Although the thickness of superdirective speaker 21*b* and that of attachment part 19*b* are almost the same in the configuration of FIG. 5, in a manner similar to the first embodiment, the thickness of superdirective speaker 21*b* may be larger than that of attachment part 19*b*. In this case, for example, in a manner similar to the first embodiment, a part of wall face 30 may be concave face 29*b*, and the part other than concave face 29*b* of wall face 30 may be formed by a face having a curvature different from that of concave face 29*b*. The curvature of convex face 27*b* may not be constant as long as it is larger than that of concave face 29*b*. In the second embodiment, the relation between the thickness of superdirective speaker 21*b* and the thickness of attachment part 19*b* is not limited.

As described above, in the sound reproduction device in the second embodiment, in the configuration that entire side surface 25 is convex face 27*b* and the curvature of convex face 27*b* is slightly larger than that of concave face 29*b*, as long as arm 33 does not come into contact with attachment part 19*b*, the listener can freely move superdirective speaker 21*b* in attachment part 19*b*. Therefore, the degree of freedom of designing the shape of sound reproduction device increases, and the range in which the angle of sound wave emitting face 23 of superdirective speaker 21*b* can be adjusted can be widened.

Angle adjusting unit 31 may be provided for superdirective speaker 21*a* in the first embodiment. With the configuration, even in the case where a listener cannot easily touch side surface 25 depending on the place of installing superdirective speaker 21*a* in dashboard 11, the listener can easily adjust the angle of sound wave emitting face 23.

Third Exemplary Embodiment

Figure 7:
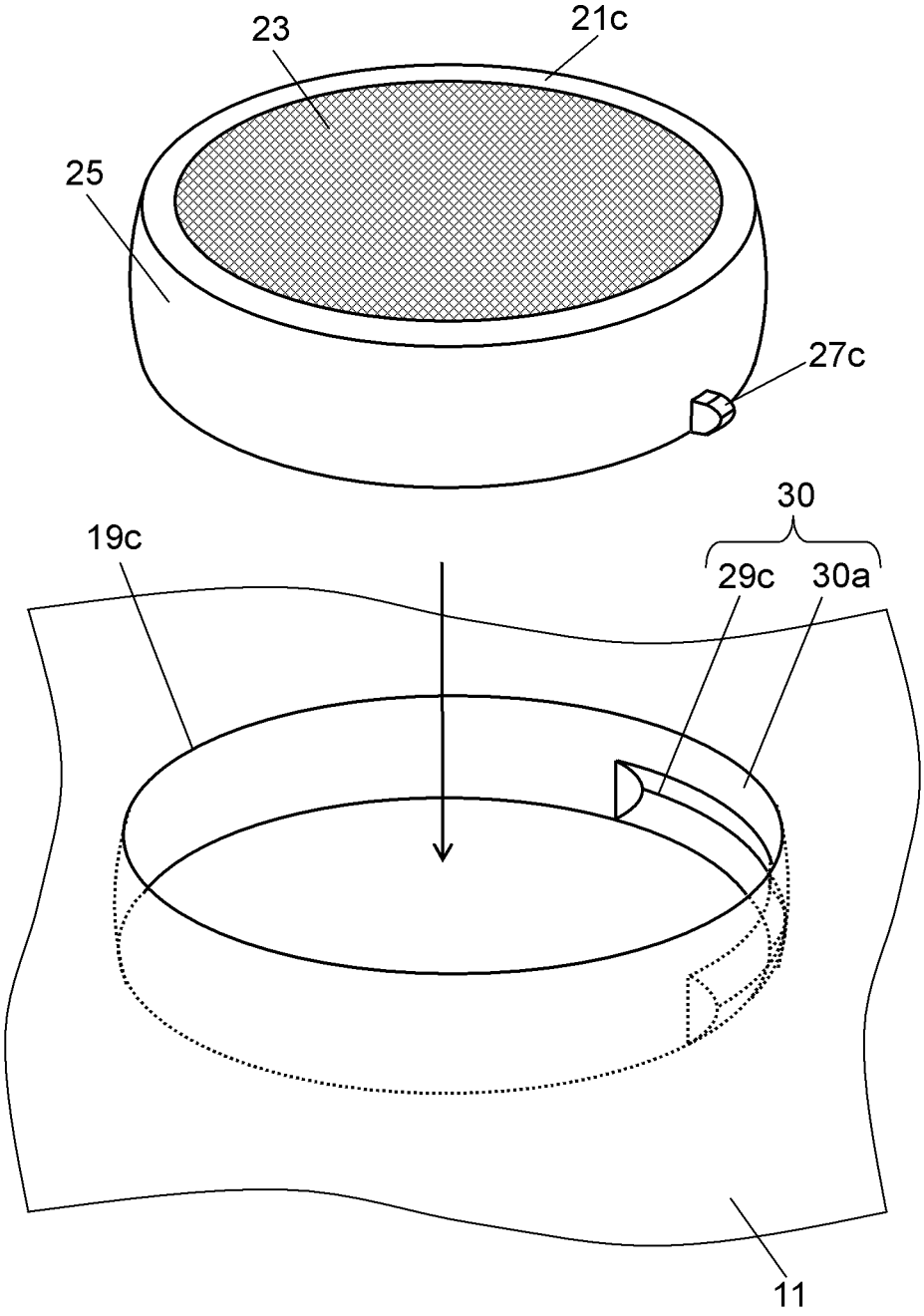
FIG. 7 is a partial exploded perspective view of a sound reproduction device in a third embodiment.
Figure 8:
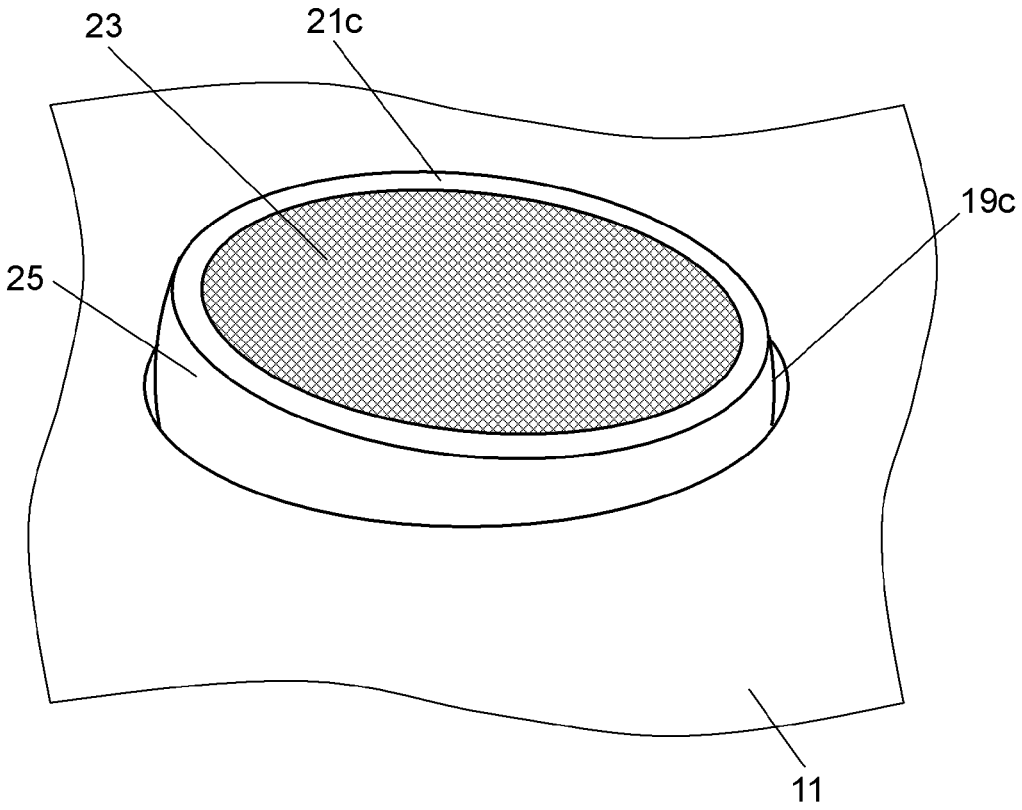
FIG. 8 is a perspective view when the angle of the sound reproduction device in the third embodiment is adjusted.

FIG. 7 is a partial exploded perspective view of a sound reproduction device in a third embodiment. FIG. 8 is a perspective view when the angle of the sound reproduction device in the third embodiment is adjusted.

In FIGS. 7 and 8, the same reference numerals are designated to the same components as those of the sound reproduction device of FIG. 3 and FIGS. 4A to 4C and their description will not be repeated. The sound reproduction device in the third embodiment is different from the sound reproduction device in the first embodiment with respect to the points that it has convex face 27*c* in side surface 25 of superdirective speaker 21*c* and concave face 29*c* formed in attachment part 19*c* in place of convex face 27*a* and concave face 29*a* illustrated in FIG. 4A.

As illustrated in FIG. 7, convex face 27*c* is formed in a lower side (dashboard 11 side) of side surface 25 of superdirective speaker 21*c*. Convex face 27*c* is not formed in the entire periphery of side surface 25 but is formed only in a part in the circumference direction of side surface 25. Concave face 29*c* is formed in wall face 30 opposed to convex face 27*c* of attachment part 19*c*. Concave face 29*c* is formed not in the entire periphery but in a part of wall face 30 on the inside of attachment part 19*c*.

By forming convex face 27*c* and concave face 29*c* not in the entire periphery but in a part of wall face 30, the turn angle of superdirective speaker 21*c* can be regulated so that superdirective speaker 21*c* is not moved more than one rotation.

Such a configuration can prevent excessive torsion in a wiring cable connecting superdirective speaker 21*c* and the drive controller, which is caused by continuous adjustment of the angle of superdirective speaker 21*c*.

The curvature of convex face 27*c* is larger than that of concave face 29*c*. Convex face 27*c* can move along concave face 29*c*.

The tilt angles in the horizontal and vertical directions of sound wave emitting face 23 of superdirective speaker 21*c* can be set to the same or can be set different from each other. Consequently, when a listener adjusts the emitting direction of the sound wave of superdirective speaker 21*c*, it is unnecessary to adjust the angle by 180 degrees or more. When the shape that superdirective speaker 21*c* cannot be turned by 180 degrees or more in the circumferential direction of sound wave emitting face 23 is employed as the shape of convex face 27*c* and the shape of concave face 29*c*, it is not a practical regulation for the sound reproduction device.

Therefore, superdirective speaker 21*c* can be turned in the circumferential direction or can be tilted in the thickness direction in a state where it is held in attachment part 19*c*, and the angle of superdirective speaker 21*c* can be adjusted as illustrated in FIG. 8.

With the configuration and operation as described above, the sound reproduction device in which a listener can easily adjust the angle of superdirective speaker 21*c* and no excessive load is applied to the wiring cable of superdirective speaker 21*c* can be realized.

Although one set is made by one convex face 27*c* and one concave face 29*c* in the third embodiment, one set may be made by one concave face 29*c* and a plurality of convex faces 27*c*, or a plurality of sets each made of one convex face 27*c* and one concave face 29*c* may be provided. With such configurations, holding of superdirective speaker 21*c* becomes more stable as compared with the case using only one set.

However, when a number of sets of convex face 27*c* and concave face 29*c* are provided, there is the possibility that the turnable angle of superdirective speaker 21*c* becomes smaller and the adjustable range is narrowed. In the case of providing a plurality of sets of convex face 27*c* and concave face 29*c*, the number of sets of convex face 27*c* and concave face 29*c* has to be a proper number by which the adjustable range necessary for the listener can be assured.

The sound reproduction device may be constructed by simultaneously having the configuration of the third embodiment and the configuration of the second embodiment. Specifically, side surface 25 in FIG. 7 is a curved face (convex face 27*b* in FIG. 5) and face 30*a* other than concave face 29*c* of wall face 30 of attachment part 19*c* becomes a curved face (concave face 29*b* in FIG. 5) corresponding to the curved face of side surface 25. The relation between the curvature of side surface 25 and the curvature of the wall face 30 may be also the same as the relation between the curvature of convex face 27*b* and the curvature of concave face 29*b* in the above-described second embodiment. The relation between the curvature of convex face 27*c* and the curvature of concave face 29*c* may be also the same as the relation between the curvature of convex face 27*b* and the curvature of concave face 29*b* in the above-described second embodiment.

With such a configuration, superdirective speaker 21*c* can be turned in the circumferential direction or tilted in the thickness direction in a state where it is held in attachment part 19*c*, and excessive torsion in the wiring cable can be prevented.

The part in which convex face 27*c* is formed in superdirective speaker 21*c* may have a structural or material spring-like structure. In this case, superdirective speaker 21*c* can be attached in attachment part 19*c* by making convex face 27*c* recessed along wall face 30 other than concave face 29*c* in attachment part 19*c* and projected in concave face 29*c*. Therefore, the efficiency of the assembling work improves.

In addition, when the part in which convex face 27*c* is formed in superdirective speaker 21*c* has spring characteristics, the shape and the material are set so that the spring tension when concave face 29*c* and convex face 27*c* are in contact becomes constant. In such a manner, superdirective speaker 21*c* and attachment part 19*c* are held by constant force. Therefore, even when the curvature of the contact face in which concave face 29*c* is in contact with convex face 27*c* is not constant, the influence of fluctuation in the curvature of concave face 29*c* is small, and attachment part 19*c* can stably hold superdirective speaker 21*c*.

Also in the configuration of the third embodiment, angle adjusting unit 31 described in the second embodiment may be provided at the periphery of superdirective speaker 21*c*. Depending on the installation place of superdirective speaker 21*c* in dashboard 11, there is a case that side surface 25 is not easily touched. Even in this case, the listener can easily adjust the angle of sound wave emitting face 23 by angle adjusting unit 31.

Fourth Exemplary Embodiment

Figure 9:
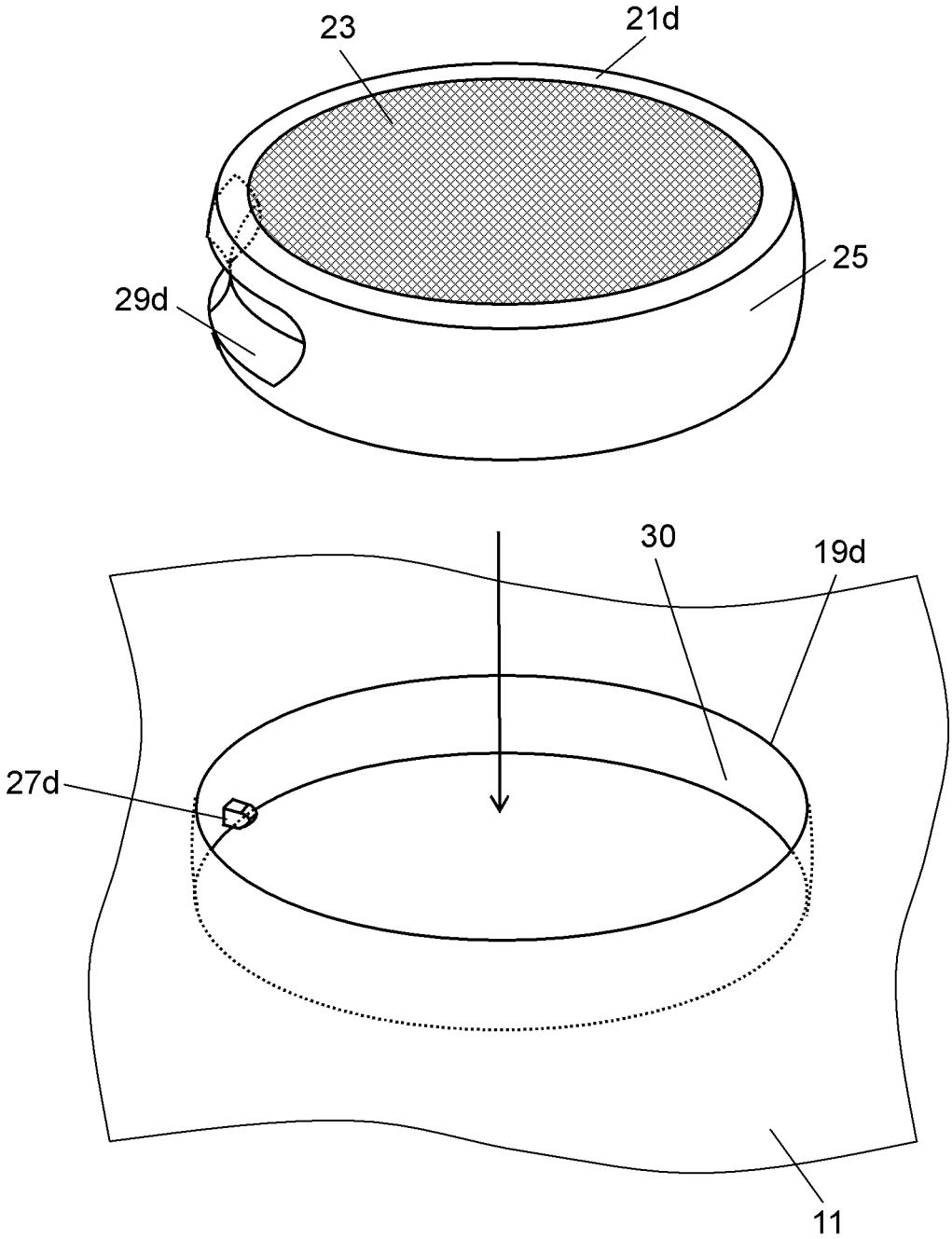
FIG. 9 is a partial exploded perspective view of a sound reproduction device in a fourth embodiment.

FIG. 9 is a partial exploded perspective view of a sound reproduction device in a fourth embodiment. In the fourth embodiment, the perspective view in which superdirective speaker 21*d* is installed in dashboard 11 is the same as FIG. 8.

In FIG. 9, the same reference numerals are designated to the same components as those of the sound reproduction device of FIG. 7 and their detailed description will not be repeated. The sound reproduction device in the fourth embodiment is different from the sound reproduction device in the third embodiment with respect to the point that the layout of the convex face and the concave face is opposite to that in FIG. 7.

Superdirective speaker 21*d* of the sound reproduction device in the fourth embodiment has concave face 29*d* entirely or partly in the side surface. Attachment part 19*d* has convex face 27*d* entirely or partly on wall face 30 opposed to concave face 29*d*. Specifically, in the configuration of FIG. 7, convex face 27*c* is provided for side surface 25 of superdirective speaker 21*c* and concave face 29*c* is provided for wall face 30 of attachment part 19*d*. In the configuration of FIG. 9, concave face 29*d* is provided for side surface 25 of superdirective speaker 21*d*, and convex face 27*d* is provided for wall face 30 of attachment part 19*d*.

In the configuration of FIG. 9, by setting the curvature of convex face 27*d* set larger than that of concave face 29*d*, the sound wave emitting direction of superdirective speaker 21*d* can be adjusted. The shape of convex face 27*d* and that of concave face 29*d* are set so that superdirective speaker 21*d* does not turn by 180 degrees or more in the circumferential direction of sound wave emitting face 23.

With the configuration and operation as described above, in a manner similar to the third embodiment, the sound reproduction device in which a listener can easily adjust the angle of superdirective speaker 21*d* and no excessive load is applied to the wiring cable of superdirective speaker 21*d* can be realized.

Also in the first and second embodiments, in a manner similar to the fourth embodiment, convex face 27*a* and concave face 29*a* may be provided in the opposite manner, and convex face 27*b* and concave face 29*b* may be provided in the opposite manner.

Fifth Exemplary Embodiment

Figure 10A:
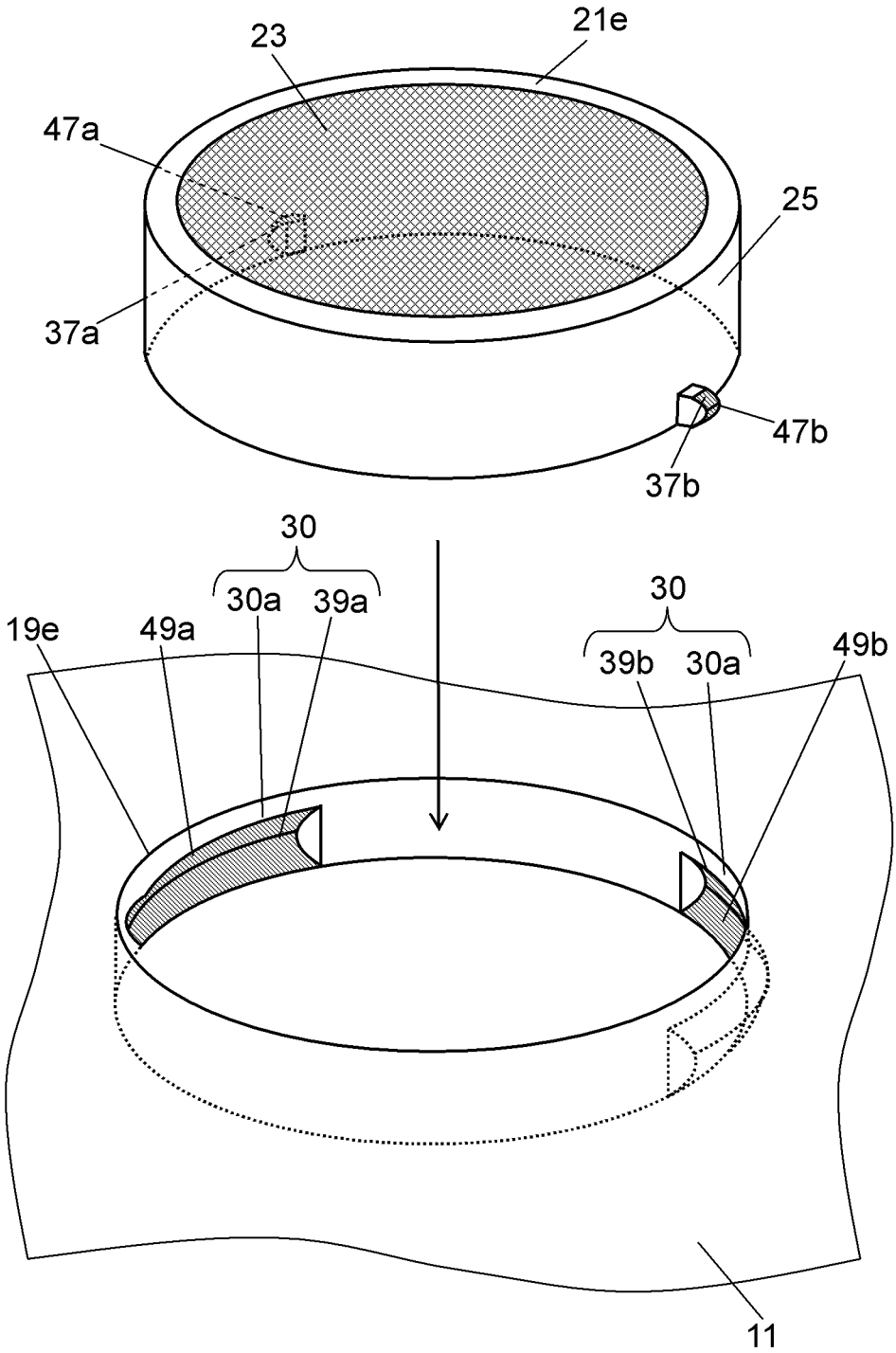
FIG. 10A is a partial exploded perspective view of a sound reproduction device in a fifth embodiment.
Figure 10B:
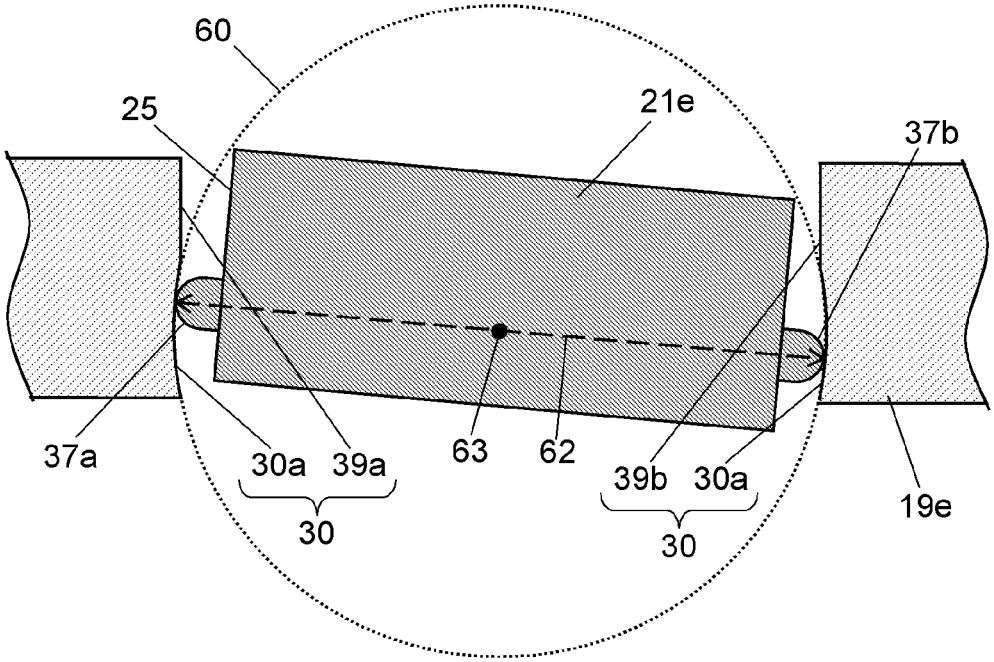
FIG. 10B is a sectional schematic view when the angle of the sound reproduction device in the fifth embodiment is adjusted.

FIG. 10A is a partial exploded perspective view of a sound reproduction device in a fifth embodiment. FIG. 10B is a sectional schematic view when the angle of the sound reproduction device in the fifth embodiment is adjusted. In the fifth embodiment, a perspective view when superdirective speaker 21*e* is installed in dashboard 11 is the same as FIG. 8.

In FIG. 10A, the same reference numerals are designated to the same components as those of the sound reproduction device of FIG. 7 and their detailed description will not be repeated. The sound reproduction device in the fifth embodiment is different with respect to the point that an electrode is provided for each of side surface 25 of superdirective speaker 21*e* and an attachment part 19*e* of dashboard 11.

Superdirective speaker 21*e* has convex faces 37*a* and 37*b*. In convex face 37*a* in superdirective speaker 21*e*, electrode 47*a* on a hot side is formed in the entire face in which convex face 37*a* and concave face 39*a* come into contact with each other. In convex face 37*b* in superdirective speaker 21*e*, electrode 47*b* on the ground side is formed in the entire face in which convex face 37*b* and concave face 39*b* come into contact with each other.

Wall face 30 of attachment part 19*e* has concave faces 39*a* and 39*b* and face 30*a* as the face other than concave faces 39*a* and 39*b*. Concave faces 39*a* and 39*b* in attachment part 19*e* are faces which can come into contact with convex faces 37*a* and 37*b*, respectively, and the curvature of convex faces 37*a* and 37*b* is larger than that of concave faces 39*a* and 39*b*. In FIG. 10B, spherical face 60 is a spherical face of a sphere having a diameter slightly larger than the largest outside diameter 62 of superdirective speaker 21*e* including convex faces 37*a* and 37*b*. Concave faces 39*a* and 39*b* are faces having curvature equal to the curvature of spherical face 60. Concave faces 39*a* and 39*b* are positioned on spherical face 60.

In concave face 39*a*, hot-side electrode 49*a* is formed. In concave face 39*b*, ground-side electrode 49*b* is formed. When convex face 37*a* and concave face 39*a* come into contact with each other and convex face 37*b* and concave face 39*b* come into contact with each other, hot-side electrodes 47*a* and 49*a* come into contact with each other, and ground-side electrodes 47*b* and 49*b* come into contact with each other. As described above, the sound reproduction device shown in FIGS. 10A and 10B has the two electrode pairs.

With such a configuration, in a state where superdirective speaker 21*e* is held in attachment part 19*e*, superdirective speaker 21*e* can be turned in the circumferential direction or tilted in the thickness direction. Further, when hot-side electrodes 47*a* and 49*a* and ground-side electrodes 47*b* and 49*b* come into contact with each other, electric connection can be obtained. Therefore, an electric signal can be supplied from attachment part 19*e* to superdirective speaker 21*e*, and a wiring cable connecting superdirective speaker 21*e* and the drive controller is unnecessary.

The hot-side electrode 49*a* and the ground-side electrode 49*b* formed in attachment part 19*e* do not have a shape which extends in the entire circumference of wall face 30 on the inside of attachment part 19*e*. Electrode 49*a* and ground-side electrode 49*b* are set in positions where they do not interfere with each other in the range of adjusting the direction of emitting the sound wave of superdirective speaker 21*e*, particularly, in the turn direction of superdirective speaker 21*e*.

As described above, superdirective speaker 21*e* is not turned by 180 degrees or more at the time of adjusting the sound wave emitting direction of superdirective speaker 21*e*, so that regulation of the turning angle of superdirective speaker 21*e* does not bring regulation in practical use of the sound reproduction device.

With the configuration and operation as described above, the sound reproduction device in which a listener can easily adjust the angle of superdirective speaker 21*e* and which does not need a wiring cable connecting superdirective speaker 21*e* and the drive controller can be realized.

In the fifth embodiment, electrodes 47*a*, 47*b*, 49*a*, and 49*b* are provided in entire faces in which convex faces 37*a* and 37*b* and concave faces 39*a* and 39*b* come into contact with each other. However, the present invention is not limited to the configuration. As long as it is within the range of adjusting the sound wave emitting direction of superdirective speaker 21*e* and the range in which an electric signal can be supplied from attachment part 19*e* to superdirective speaker 21*e*, electrodes may be formed in a part of the faces in which convex faces 37*a* and 37*b* and concave faces 39*a* and 39*b* come into contact with each other.

As long as it is within the above-described range, hot-side electrode 47*a* and the ground-side electrode 47*b* provided for superdirective speaker 21*e* may be formed in a part of the faces in which convex faces 37*a* and 37*b* and concave faces 39*a* and 39*b* come into contact with each other, and electrodes 49*a* and 49*b* may be provided in the entire concave faces 39*a* and 39*b*. In an opposite manner, electrodes 49*a* and 49*b* are formed in a part of concave faces 39*a* and 39*b*, respectively, and hot-side electrode 49*a* and ground-side electrode 49*b* may be provided for convex faces 37*a* and 37*b* in the entire faces in which convex faces 37*a* and 37*b* come into contact with concave faces 39*a* and 39*b*, respectively.

In the case of forming electrodes 49*a* and 49*b* in a part of concave faces 39*a* and 39*b*, respectively, when convex face 37*a* or 37*b* is moved to a position where electrodes 49*a* and 49*b* are not formed, an electric signal cannot be supplied to superdirective speaker 21*e*. Therefore, only by changing the sound wave emitting direction of superdirective speaker 21*e*, input/output of a sound signal can be also operated.

Although concave faces 39*a* and 39*b* are disposed so as to be deviated from positions where they are opposed to each other in the fifth embodiment as illustrated in FIG. 10A, they may be disposed so as to be opposed to each other. That is, as long as electrodes 49*a* and 49*b* formed in concave faces 39*a* and 39*b* do not mechanically interfere with each other and are not electrically short-circuited, concave faces 39*a* and 39*b* may be disposed in any positions in attachment part 19*e*.

Although the case using the two electrode pairs has been described in the fifth embodiment, the present invention is not limited to the case and three or more electrode pairs may be used. In this case, for example, as long as superdirective speaker 21*e* has the drive controller therein, the power supply and signal systems of the sound signal, the control signal, and the like can be separately connected to superdirective speaker 21*e*.

Also in the fifth embodiment, in a manner similar to the fourth embodiment, convex faces 37*a* and 37*b* and concave faces 39*a* and 39*b* may be provided on the opposite sides.

Sixth Exemplary Embodiment

Figure 11:
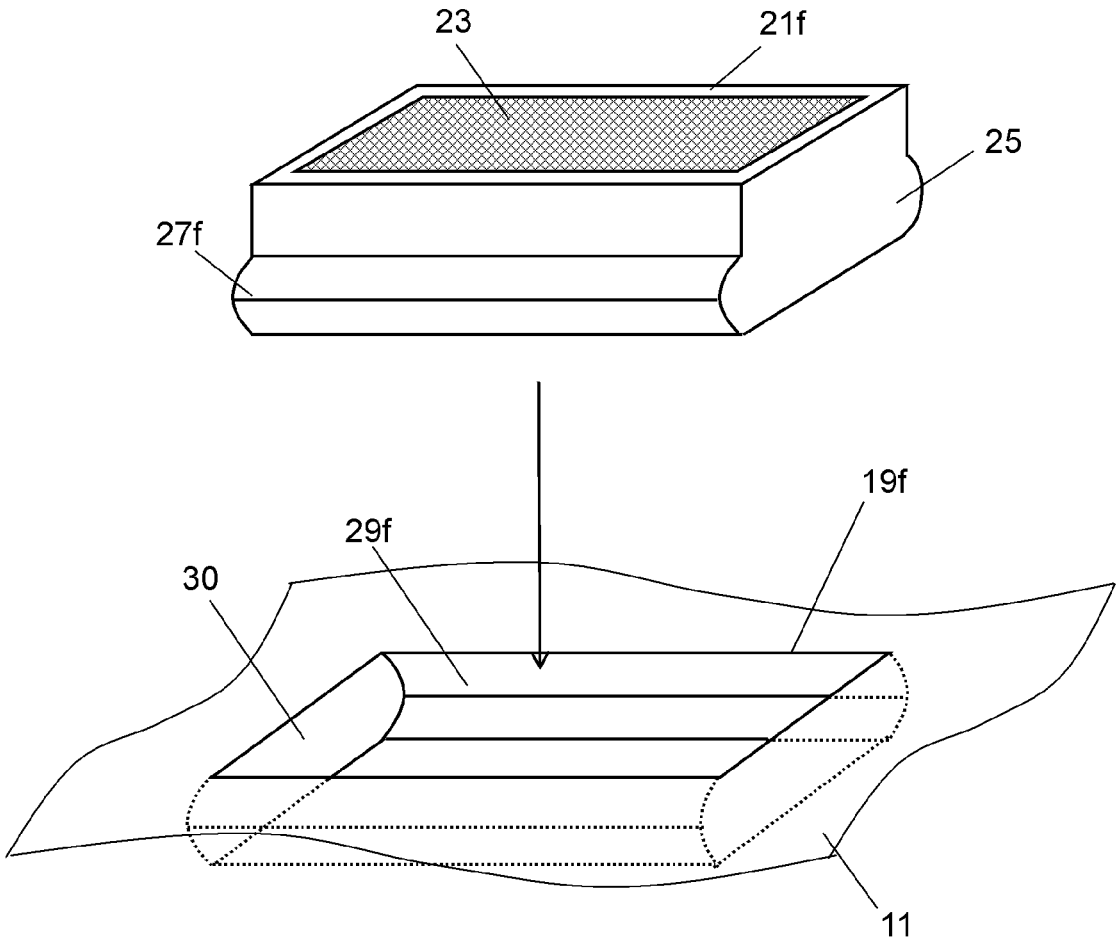
FIG. 11 is a partial exploded perspective view of a sound reproduction device in a sixth embodiment.

FIG. 11 is a partial exploded perspective view of a sound reproduction device in a sixth embodiment. The basic configuration of the sound reproduction device in FIG. 11 is similar to that of the sound reproduction device of the first embodiment in FIG. 4A except for the point that the appearance of the shape of superdirective speaker 21*f* has a rectangular column shape.

Convex faces 27*f* are provided in a set of opposed faces in four side surfaces 25 adjacent to sound wave emitting face 23. Concave face 29*f* is provided in wall face 30 of attachment part 19*f* opposed to convex face 27*f*. The relation between the curvature of convex face 27*f* and the curvature of concave face 29*f* is similar to that in the first embodiment.

With such a configuration, a listener can easily adjust the angle of sound wave emitting face 23 of superdirective speaker 21*f*.

The configuration illustrated in FIG. 11 can be also applied to the first to fifth embodiments.

Seventh Exemplary Embodiment

Figure 12A:
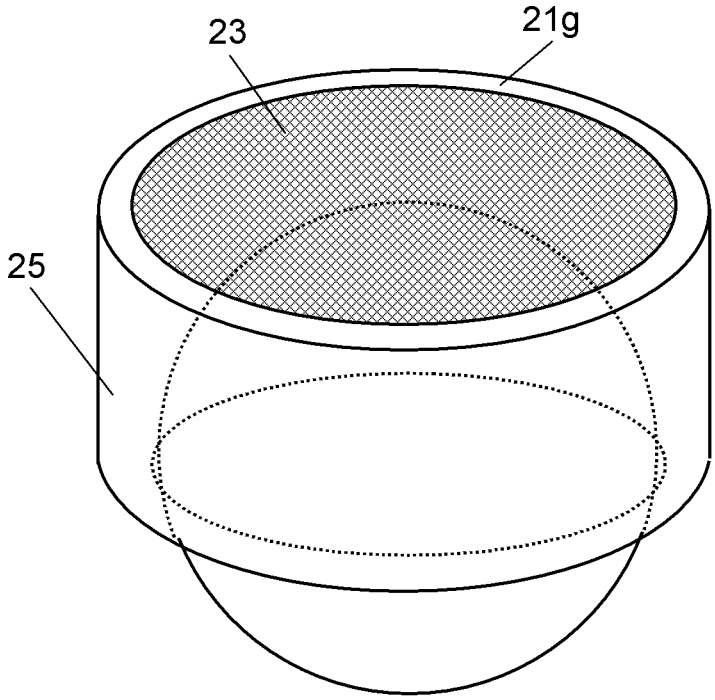
FIG. 12A is a partial exploded perspective view of a sound reproduction device in a seventh embodiment.
Figure 12B:
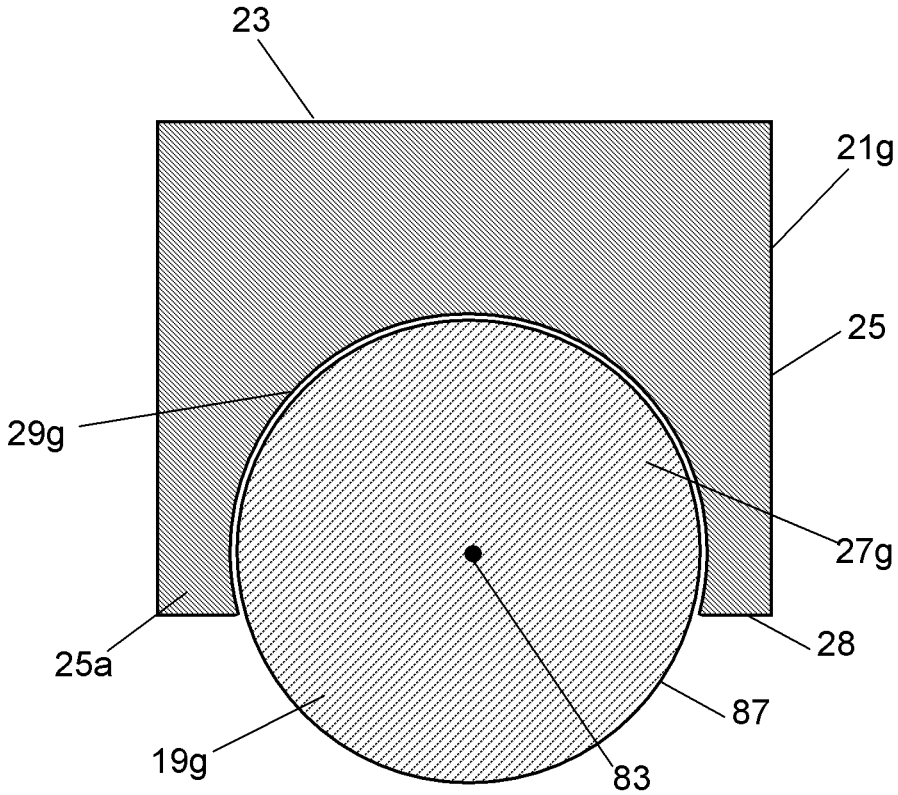
FIG. 12B is a sectional schematic view of the sound reproduction device in the seventh embodiment.

FIG. 12A is a partial exploded perspective view of a sound reproduction device in a seventh embodiment. FIG. 12B is a sectional schematic view of the sound reproduction device in the seventh embodiment. The basic configuration of superdirective speaker 21*g* of the sound reproduction device in FIG. 12A is similar to that of the sound reproduction device of the fourth embodiment in FIG. 9 except for the point that concave face 29*g* is formed in under surface 28 of superdirective speaker 21*g*.

Attachment part 19*g* has a spherical shape. Surface 87 of attachment part 19*g* has convex face 27*g*. Convex face 27*g* has a curvature larger than that of concave face 29*g*. Since attachment part 19*g* has a spherical shape in the seventh embodiment, entire surface 87 of attachment part 19*g* is convex face 27*g*.

Attachment part 19*g* is fixed so as not to interfere with the dashboard at the time of changing the direction of superdirective speaker 21*g* in a part which is not in contact with concave face 29*g*, and at least a part of superdirective speaker 21*g* is projected to the inside of a vehicle compartment.

Side surface 25 of superdirective speaker 21*g* has lower end 25*a* lower than center 83 of attachment part 19*g* as a sphere. Concave face 29*g* extends along surface 87 beyond center 83 of attachment part 19*g* to lower end 25*a*.

In such a manner, superdirective speaker 21*g* does not easily come off from attachment part 19*g*.

In the sound reproduction device illustrated in FIGS. 12A and 12B, entire attachment part 19*g* is a sphere having surface 87 of the curvature larger than that of concave face 29*g*. It is sufficient that the part which comes into contact with concave face 29*g* in surface 87 is formed as convex face 27*g* having the curvature larger than that of concave face 29*g*.

Attachment part 19*g* may be formed integrally with the dashboard. That is, by integrally forming a spherical face which comes into contact with concave face 29*g* in a part of the dashboard, attachment part 19*g* may be constructed.

Even with such a configuration, a listener can easily adjust the angle in the circumferential direction or the thickness direction of superdirective speaker 21*g*.

The configuration illustrated in FIGS. 12A and 12B can be also applied to the first to sixth embodiments.

In the sound reproduction devices of the first to seventh embodiments, a listener manually adjusts the angle of superdirective speakers 21*a* to 21*g*. However, the present invention is not limited to the configuration. The direction of emitting a sound wave from superdirective speakers 21*a* to 21*g* may be controlled by a control signal from a configuration other than the configuration of the sound reproduction device. For example, a motor is installed so that the direction of emitting a sound wave from superdirective speakers 21*a* to 21*g* can be adjusted. By controlling the motor with a switch provided near a listener, the direction of emitting a sound wave of superdirective speakers 21*a* to 21*g* can be easily adjusted. With such a configuration, a listener can precisely adjust the direction of emitting a sound wave of superdirective speakers 21*a* to 21*g* without largely moving from a listening position.

The direction of emitting a sound wave of superdirective speakers 21*a* to 21*g* may be adjusted by a control signal from a configuration other than the configuration of the sound reproduction device. For example, the direction of emitting a sound wave of superdirective speakers 21*a* to 21*g* may be adjusted interlockingly with the angle of the mirror surface of an electric door mirror or fender mirror mounted on a vehicle. Since the seating position of the listener can be estimated from the adjustment of the door mirror or fender mirror, the direction of emitting a sound wave of superdirective speakers 21*a* to 21*g* can be determined on the basis of the estimated seating position. Therefore, the relation between the mirror surface angle of the mirror and the direction of emitting a sound wave of superdirective speakers 21*a* to 21*g* is defined in advance. Only by electric adjustment on the door mirror or fender mirror on the basis of the relation by the listener, the direction of emitting a sound wave of superdirective speakers 21*a* to 21*g* can be automatically adjusted. The relation between not only the mirror surface angle of the mirror but also seat position and the direction of emitting a sound wave of superdirective speakers 21*a* to 21*g* may be also defined.

Figure 13:
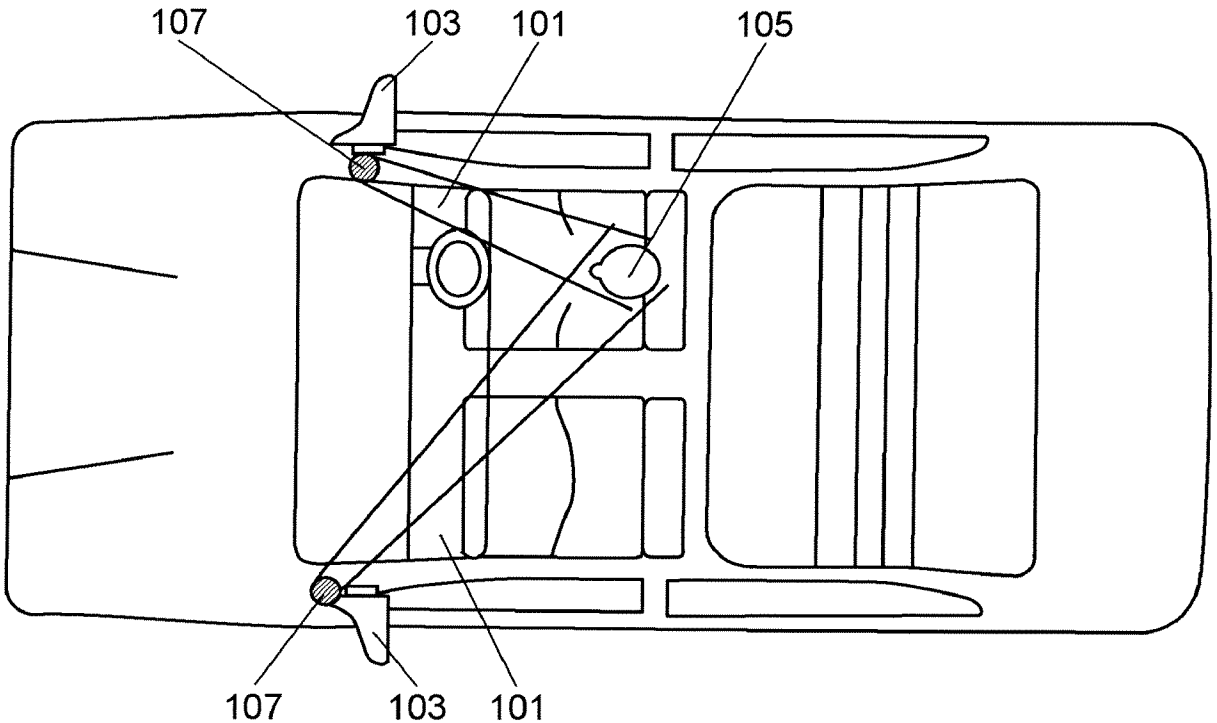
FIG. 13 PRIOR ART
FIG. 13 is a layout of speakers of a conventional information transmitting device.

Further, like the configuration of FIG. 13 illustrating the conventional sound reproduction device, any of superdirective speakers 21*a* to 21*g* may be installed near the place where the door mirror is attached. In the case where the vehicle has a door mirror electric adjusting function, a door mirror driving part and any of superdirective speakers 21*a* to 21*g* are mechanically connected by a gear or the like. If the relation between the mirror face angle of the door mirror and the direction of emitting a sound wave of superdirective speakers 21*a* to 21*g* is set, the door mirrors and any of superdirective speakers 21*a* to 21*g* can be simultaneously driven by the same motor. With the configuration, a listener can easily and precisely adjust the direction of emitting a sound wave of superdirective speakers 21*a* to 21*g*. In addition, the motor only for adjusting the direction of emitting a sound wave of superdirective speakers 21*a* to 21*g* becomes unnecessary, so that the cost can be also reduced.

Although the case of installing the sound reproduction devices of the first to seventh embodiments to a vehicle has been described, the present invention is not limited to the case. The present invention may be also applied to equipment for sound such as a speaker system, an audio visual device, or an information device using any of superdirective speakers 21*a* to 21*g*.

INDUSTRIAL APPLICABILITY

In the sound reproduction device in the present invention, a listener can easily adjust the angle of the superdirective speaker. Therefore, it is particularly useful as a sound reproduction device or the like using the superdirective speaker for reproducing a sound signal to a specific listener.

REFERENCE MARKS IN THE DRAWINGS

19*a*, 19*b*, 19*c*, 19*d*, 19*e*, 19*f*, 19*g* attachment part
21*a*, 21*b*, 21*c*, 21*d*, 21*e*, 21*f*, 21*g* superdirective speaker
23 sound wave emitting face (top surface)
25 side surface (first surface)
27*a*, 27*b*, 27*c*, 27*d*, 27*e*, 27*f*, 27*g*, 37*a*, 37*b* convex face
29*a*, 29*b*, 29*c*, 29*d*, 29*e*, 29*f*, 29*g*, 39*a*, 39*b* concave face
28 under surface (first surface)
30 wall face (second surface)
47*a*, 47*b*, 49*a*, 49*b* electrode
65 center axis
87 surface (second surface)

The invention claimed is:

1. A sound reproduction device comprising:
a superdirective speaker having a sound wave emitting face for emitting an ultrasonic wave and a first surface; and
an attachment part having a second surface opposed to the first surface, wherein:
at least a part of the sound wave emitting face of the superdirective speaker is a mirror face,
the first surface has a convex face,
the second surface has a concave face which can come into contact with the convex face,
a curvature of the convex face is set larger than that of the concave face, and
a direction of emitting a sound wave of the superdirective speaker is adjusted by changing tilt of the sound wave emitting face by moving the convex face along the concave face.

2. The sound reproduction device according to claim 1, wherein
a first electrode is provided on an entire or a part of the convex face, a second electrode is provided on an entire or a part of the concave face, and
an electric signal is supplied from the attachment part to the superdirective speaker by a pair of the first and second electrodes.

3. The sound reproduction device according to claim 1, wherein
the superdirective speaker has substantially a circular columnar shape having a top surface, an under surface, and a side surface connected to the top surface and the under surface,
the first surface is the side surface of the circular columnar shape,
the top surface is the sound wave emitting face, and
each of the curvature of the convex face and the curvature of the concave face is a curvature in a section including a center axis of the circular columnar shape.

4. The sound reproduction device according to claim 3, wherein
a first electrode is provided on an entire or a part of the convex face, a second electrode is provided on an entire or a part of the concave face, and
an electric signal is supplied from the attachment part to the superdirective speaker by a pair of the first and second electrodes.

5. The sound reproduction device according to claim 4, wherein the convex face and the concave face are constructed so that the superdirective speaker is not turned by 180 degrees or more in a circumferential direction of the sound wave emitting face.

6. A sound reproduction device comprising:
a superdirective speaker having a sound wave emitting face for emitting an ultrasonic wave and a first surface; and
an attachment part having a second surface opposed to the first surface, wherein:
at least a part of the sound wave emitting face of the superdirective speaker is a mirror face,
the second surface has a convex face,
the first surface has a concave face which can come into contact with the convex face,
a curvature of the convex face is set larger than that of the concave face, and
a direction of emitting a sound wave of the superdirective speaker is adjusted by changing tilt of the sound wave emitting face by moving the convex face move along the concave face.

7. The sound reproduction device according to claim 6, wherein
a first electrode is provided on an entire or a part of the convex face, a second electrode is provided on an entire or a part of the concave face, and
an electric signal is supplied from the attachment part to the superdirective speaker by a pair of the first and second electrodes.

8. The sound reproduction device according to claim 6, wherein
the superdirective speaker has substantially a circular columnar shape having a top surface, an under surface, and a side surface connected to the top surface and the under surface,
the first surface is the side surface of the circular columnar shape,
the top surface is the sound wave emitting face, and
each of the curvature of the convex face and the curvature of the concave face is a curvature in a section including a center axis of the circular columnar shape.

9. The sound reproduction device according to claim 8, wherein
a first electrode is provided on an entire or a part of the convex face, a second electrode is provided on an entire or a part of the concave face, and
an electric signal is supplied from the attachment part to the superdirective speaker by a pair of the first and second electrodes.

10. The sound reproduction device according to claim 9, wherein the convex face and the concave face are constructed so that the superdirective speaker is not turned by 180 degrees or more in a circumferential direction of the sound wave emitting face.

* * * * *